US008596552B2

(12) United States Patent
Nicolaisen et al.

(10) Patent No.: US 8,596,552 B2
(45) Date of Patent: Dec. 3, 2013

(54) VALVE FOR USE IN A REFRIGERATION SYSTEM

(75) Inventors: Holger Nicolaisen, Nordborg (DK); Jens Erik Rasmussen, Graasten (DK); Torben Funder-Kristensen, Soenderborg (DK); Joergen Trelle-Pedersen, Nordborg (DK); Torben Matzon, Nordborg (DK); Anders Vestergaard, Soenderborg (DK); Lars Mou Jessen, Nordborg (DK)

(73) Assignee: Danfoss A/S, Nordborg (DK)

( * ) Notice: Subject to any disclaimer, the term of this patent is extended or adjusted under 35 U.S.C. 154(b) by 1520 days.

(21) Appl. No.: 11/577,405

(22) PCT Filed: Oct. 14, 2005

(86) PCT No.: PCT/DK2005/000661

§ 371 (c)(1),
(2), (4) Date: Jul. 20, 2007

(87) PCT Pub. No.: WO2006/042544

PCT Pub. Date: Apr. 27, 2006

(65) Prior Publication Data

US 2008/0087038 A1 Apr. 17, 2008

(30) Foreign Application Priority Data

Oct. 21, 2004 (DK) ..... 2004 01615

(51) Int. Cl.
*F25B 41/04* (2006.01)

(52) U.S. Cl.
USPC ..... 236/92 B; 62/498; 62/527; 62/222

(58) Field of Classification Search
USPC ..... 62/498, 527, 222; 236/92 B
See application file for complete search history.

(56) References Cited

U.S. PATENT DOCUMENTS 1,546,487 A * 7/1925 Goosmann ..... 137/495
4,632,305 A 12/1986 Fujiwara (Continued)

FOREIGN PATENT DOCUMENTS

DE 19631914 A1 2/1997
EP 0786632 A2 7/1997

(Continued)

OTHER PUBLICATIONS

Maurer et al. German Publication No. DE 19631914, Published Feb. 13, 1997, Machine translated Apr. 30, 2009.*

(Continued)

*Primary Examiner* — Cheryl J Tyler
*Assistant Examiner* — Jonathan Koagel
(74) *Attorney, Agent, or Firm* — McCormick, Paulding & Huber LLP

(57) ABSTRACT

A valve (4) for a refrigeration system. Comprises two diaphragms (8, 10) being operatively connected. One diaphragm (8) is in contact with the refrigerant, the other (10) is in contact with the filling fluid. The two diaphragms (8, 10) may have different active areas. In combination with the connection between the two diaphragms (8, 10) this provides a 'pressure gearing' between the filling fluid and the refrigerant. Allows the pressure of the filling fluid to be relatively low even when the pressure of the refrigerant is high, while ensuring that the valve (4) can function properly. Particularly suitable for high pressure refrigeration systems, such as $CO_2$ systems.

2 Claims, 1 Drawing Sheet

(56) References Cited

U.S. PATENT DOCUMENTS

| | | | |
|---|---|---|---|
| 4,911,404 | A | 3/1990 | Dorste et al. |
| 5,065,595 | A | 11/1991 | Seener et al. |
| 5,364,066 | A | 11/1994 | Dorste et al. |
| 5,890,370 | A | 4/1999 | Sakakibara et al. |
| 6,568,656 | B1 | 5/2003 | Wrocklage |
| 6,626,000 | B1 | 9/2003 | Meyer et al. |

FOREIGN PATENT DOCUMENTS

| | | | | | |
|---|---|---|---|---|---|
| EP | 1052463 | A2 | | 4/2000 | |
| EP | 1335160 | A2 | | 1/2003 | |
| EP | 1457747 | A2 | | 3/2004 | |
| JP | 05312421 | A | * | 11/1993 | ..... F25B 5/04 |
| JP | 2001153499 | | | 6/2001 | |
| JP | 2001280721 | | | 10/2001 | |
| JP | 2001324245 | | | 11/2001 | |
| JP | 2000346498 | | | 12/2002 | |
| WO | WO 2005038320 | A2 | * | 4/2005 | ..... F16K 7/17 |

OTHER PUBLICATIONS

Takeuchi, JP Publication No. 05-312421, Published Nov. 22, 1993, Machine translated Apr. 30, 2009.*

Operation of Trans-Critical CO2 Vapour Compression Circuits in Vehicle Air Conditioning by J. Pettersen, et al., XP001165464; pp. 495-505.

International Search Report for Serial No. PCT/DK2005/000661 dated Dec. 7, 2005.

* cited by examiner

VALVE FOR USE IN A REFRIGERATION SYSTEM

CROSS REFERENCE TO RELATED APPLICATIONS

This application is entitled to the benefit of and incorporates by reference essential subject matter disclosed in International Patent Application No. PCT/DK2005/000661 filed on Oct. 14, 2005 and Danish Patent Application No. PA 2004 01615 filed Oct. 21, 2004.

FIELD OF THE INVENTION

The present invention relates to a valve, in particular an expansion valve, such as a thermostatic expansion valve, for use in a refrigeration system. The valve of the present invention is particularly suitable for use in a refrigeration system, where the refrigerant has a relatively high pressure, e.g. a $CO_2$ refrigeration system.

BACKGROUND OF THE INVENTION

Thermostatic expansion valves have previously been used in refrigeration systems using traditional refrigerants, such as R134a, R404A, R407A, R407B, R407C and R410C. In this case the expansion valve will typically function as a throttle valve regulating the superheating at the outlet side of the evaporator. This is typically done by means of a sensor positioned at the outlet of the evaporator. When an expansion valve is used in a $CO_2$ refrigeration system, it still functions as a throttle valve as described above. However, in this case it does not regulate the superheating at the outlet side of the evaporator. Instead it regulates the pressure in the heat emitter, also in some cases called the gas cooler.

During the pressure regulation it will normally be attempted to obtain an optimal coefficient of performance (COP). When a $CO_2$ refrigeration system runs supercritically, a specific pressure in the heat emitter is in principle coupled to each combination of evaporation temperature in the evaporator and outlet temperature of the heat emitter in order to obtain optimal COP. The pressure of the heat emitter is normally regulated by means of the thermostatic expansion valve and a sensor being filled with a gas/liquid mixture. This sensor functions like the sensor of a traditional system, i.e. the measured temperature at the outlet of the heat emitter is transformed into a corresponding pressure which is used for shifting a closing element in the valve. U.S. Pat. No. 5,890,370 discloses further details relating to obtaining optimal COP.

In prior art expansion valves for refrigeration systems using traditional refrigerants there is provided a sensor chamber and an evaporation pressure chamber. These chambers are separated by a diaphragm. In order to allow the valve to function properly, it must be ensured that the forces acting on the diaphragm from either side, i.e. the forces arising due to the pressure in the two chambers, must be of comparable size, e.g. of the same order of magnitude. Since both pressures act on equal areas of the diaphragm this means that the two pressures must be of comparable size. This is normally not a problem in refrigeration systems using traditional refrigerants, since the pressure of the refrigerant in such systems during operation is normally relatively low, typically approximately 1-12 Bar, though in some situations the valve may be subject to pressures up to approximately 42 Bar. It is well known to construct a system in which such pressures are present in a cost effective way.

However, when a refrigeration system is desired which uses a high pressure refrigerant, such as $CO_2$, the pressure of the refrigerant will normally be as high as approximately 60-90 Bar. This puts strict requirements on the durability, strength and thickness of material of the valve, in particular of the diaphragm and parts surrounding the diaphragm, such as the walls of the sensor chamber and the evaporation chamber, thereby increasing production costs and making the manufacturing process more difficult.

SUMMARY OF THE INVENTION

It is, thus, an object of the present invention to provide a valve for use in a refrigeration system which is suitable for use in a system using a high pressure refrigerant.

It is a further object of the present invention to provide a valve which is suitable for use in a high pressure refrigeration system, the valve being manufactured by standard parts which are suitable for valves for low pressure refrigeration systems.

It is an even further object of the present invention to provide a valve which is suitable for use in a high pressure refrigeration system, where the forces acting on the various parts of the valve are reduced as compared to forces acting on the various parts of prior art valves.

It is an even further object of the present invention to provide a valve which is easy and cost effective to manufacture while at the same time being capable of withstanding forces and stress applied to the valve during use.

According to the present invention the above and other objects are fulfilled by providing a valve, the valve being adapted to be in an open state or in a closed state, refrigerant being allowed to move from an inlet towards an outlet when the valve is in the open state, said movement being substantially prevented when the valve is in the closed state, the valve comprising:

- a first diaphragm having a first active area and a first side being in fluid contact with a refrigerant having a first pressure, said first diaphragm defining the open and closed states of the valve,
- a second diaphragm having a second active area and a first side being in fluid contact with a filling fluid having a second pressure, wherein the first and the second diaphragms are operatively connected in such a way that movement of the first/second diaphragm causes a corresponding movement of the second/first diaphragm, and wherein the first and second active areas and the first and second pressures are selected in such a way that forces acting on the first active area from the refrigerant are of substantially the same order of magnitude as and oppositely directed to forces acting on the first active area from the second diaphragm.

The refrigerant is a fluid, such as a liquid, a gas and/or a liquid/gas mixture.

In the present context the term 'active area' should be interpreted to mean a part of the respective diaphragm which generates the forces involved in controlling the valve. Thus, it may be the total area of the respective diaphragm, but it may also be just a small part of the total area of the diaphragm, for example in case the remaining part of the diaphragm is prevented from moving or is not in contact with the fluid of the adjacent chamber.

Since the first diaphragm defines the open and closed states of the valve it may be movable between two states, defining the open and the closed states, respectively, of the valve. However, the open state may in fact be defined by various positions of the diaphragm allowing various amounts of refrigerant to pass. The 'open state' may even be defined as a continuous or infinitely variable state where the amount of refrigerant passing per unit time may be set to a desired value by positioning the diaphragm appropriately. Furthermore, the first diaphragm is preferably positioned, in relation to the inlet and the outlet of the refrigerant, in such a way that when the first diaphragm is in the closed state it at least substantially blocks a fluid passage between the inlet and the outlet, and when it is in an open state it does not block the passage, i.e. it allows an amount of refrigerant corresponding to the position of the diaphragm to pass. It should be understood that in case some fluid is allowed to pass when the diaphragm is in the closed state, this fluid flow will be substantially smaller than the fluid flow when the diaphragm is in an open state.

In the present context the term 'operatively connected' should be interpreted as meaning some kind of connection between the two diaphragms which ensures that movements of one diaphragm translate into corresponding movements of the other diaphragm. Such a connection is preferably of a mechanical kind, e.g. a physical connection between the two diaphragms comprising one or more parts.

In the present context the term 'the same order of magnitude' should be interpreted as meaning of comparable size, e.g. within a factor 10. The forces should be comparable in the sense that realistic changes under actual operating conditions in a force acting on one or the other side of the first valve should be able to result in a movement of the first diaphragm causing a switch from an open state to a closed state of the valve, or vice versa.

The fact that the valve comprises two operatively connected diaphragms opens the possibility of letting forces from the first/second pressure act on the first/second active area, and subsequently transfer these forces to the second/first diaphragm via the connection. Thus, the first and second pressures do not necessarily need to be of comparable size. In case they are chosen to be of different size, all that is needed in order to provide forces of the same order of magnitude acting on either side of the first active area is to choose the first and the second active areas to have appropriate relative sizes.

This is in particular an advantage in case of a high pressure refrigeration system, such as a $CO_2$ refrigeration system. Even though the pressure of the refrigerant during operation in this case is relatively high (typically approximately 60-90 Bar), the pressure of the filling fluid during operation need not be as high, and can typically be chosen to be approximately 7-20 Bar. In this case the second active area needs to be larger than the first active area in order to ensure that the forces acting on the second diaphragm by the second pressure and subsequently being transferred to the first diaphragm are comparable in size to the forces acting directly on the first diaphragm by the first pressure. In this manner a kind of 'pressure gearing' is provided between the refrigerant and the filling fluid.

Thus, when the pressure of the filling fluid can be chosen to be relatively low, it is no longer necessary to provide specially designed or reinforced parts for the valve. Instead standard parts which have been manufactured for valves which are suitable for use in low pressure refrigeration systems may be used. This results in a considerable reduction in manufacturing costs. Furthermore, it is much easier to manufacture the valve when standard parts can be used instead of having to manufacture parts especially for high pressure refrigeration systems.

Thus, the valve of the present invention is particularly suited for being used in a refrigeration system in which the refrigerant is a high pressure fluid, such as $CO_2$.

In a preferred embodiment the first pressure is substantially larger than the second pressure as described above. In this case the various parts of the valve, in particular the diaphragms, do not need to be reinforced, and standard parts may be used.

Alternatively, the second pressure may be substantially larger than the first pressure, or the difference between the two pressures may be relatively small. Furthermore, the two pressures may be of comparable size.

In one embodiment the second active area may be substantially larger than the first active area. As described above this allows the first pressure to be relatively high without requiring that the second pressure is high, while at the same time ensuring that the forces acting on the first and second sides of the first diaphragm are of comparable size, thereby ensuring that the valve can function properly.

Alternatively, the first active area may be substantially larger than the second active area.

The valve may further comprise means for limiting the movements of the first and/or the second diaphragm. This ensures that regardless of the forces applied to the diaphragm (s) it/they will not be subject to levels of stress which may cause damage to the diaphragm(s). The means for limiting the movements of the diaphragm(s) may advantageously comprise one or more thrust pads positioned adjacent to the diaphragm in question at the side opposite the first side, i.e. facing away from the refrigerant or the filling fluid, respectively. Thus, when the diaphragm is affected by forces due to the pressure of the respective fluid, it is prevented from moving more than a certain distance in a direction away from the fluid because it will be caused to abut the thrust pad(s) after the certain distance has been travelled, thereby preventing further movement.

The valve may further comprise means for allowing a bleed of refrigerant from the inlet towards the outlet when the valve is in the closed state. In case the valve is very tight it will not be possible for refrigerant to move from the inlet to the outlet when the valve is in a closed state. In this case the pressure difference between the inlet part and the outlet part will be maintained at a relatively high level while the valve is in the closed state. When the compressor is started while the valve is in the closed state, it will have to start up against this relatively large pressure difference. This has turned out to be difficult. It is therefore an advantage to provide means for allowing a bleed of refrigerant from the inlet to the outlet in order to provide some kind of equalization of the pressure.

The bleed may be provided in the form of at least one groove in a nozzle which is covered by the first diaphragm when the valve is in the closed state. Such a groove is typically relatively small, e.g. approximately 0.1 $mm^2$ in a typical valve. In any event the groove(s) should be dimensioned in such a way that when the valve is in the closed state, the pressure will be equalized during a time interval corresponding to the typical minimal time interval in which the compressor is switched off. This may, e.g. be approximately 5-10 minutes.

In a preferred embodiment the filling fluid is a substantially pure fluid, such as propylene (R-1270) or propane (R-290). Normally a mixture of filling fluids will be chosen in order to obtain a desired relationship between pressure and temperature. Unfortunately the relationship between pressure and temperature for these kinds of mixed filling fluids is not very well defined. It is therefore an advantage of the present invention that a pure fluid may be used as filling fluid, because the relationship between pressure and temperature for these fluids is well defined.

The forces acting on the first active area from the second diaphragm preferably arise from forces from the pressure of the filling fluid acting on the second active area. Thus, in a preferred embodiment the second active area is affected by the pressure of the filling fluid. Thereby the second diaphragm, or at least the active area of the second diaphragm, i.e. the second active area, is moved in a direction away from the chamber containing the filling fluid. Due to the connection between the first and second diaphragms this causes the first diaphragm to move as well in a direction towards the refrigerant.

The first and the second diaphragms may each comprise a second side. Preferably the second side of the first diaphragm and the second side of the second diaphragm are subject to substantially the same pressure. The first and second diaphragms may in this case form part of a substantially closed chamber, e.g. containing a fluid, such as atmospheric air, having a desired pressure. Preferably the pressure in the chamber is much smaller than the first pressure and the second pressure, typically approximately atmospheric pressure. In this case forces acting on the active areas of the diaphragms due to the pressure in the chamber are negligible compared to the remaining forces acting on the diaphragms.

The valve may further comprise a closing element which abuts against a valve seat of the valve when the valve is in the closed state, thereby preventing refrigerant from moving from the inlet towards the outlet, and which does not abut against the valve seat when the valve is in the open state. The closing element may be a separate element which is operatively connected to the first diaphragm in such a way that movements of the first diaphragm causes the closing element to abut the valve seat or be removed from the valve seat. Alternatively the closing element may be or comprise the first diaphragm. In this case the valve is in the closed state when the first diaphragm abuts the valve seat and in the open state when the first diaphragm does not abut the valve seat.

The valve according to the present invention is particularly suitable for use in a refrigeration system, in particular a high pressure refrigeration system, such as a $CO_2$ refrigeration system. Apart from the valve such a system typically comprises an evaporator, a compressor and a heat emitter.

BRIEF DESCRIPTION OF THE DRAWINGS

The invention will now be described with reference to the accompanying drawings in which.

DETAILED DESCRIPTION OF THE INVENTION

Figure 1:
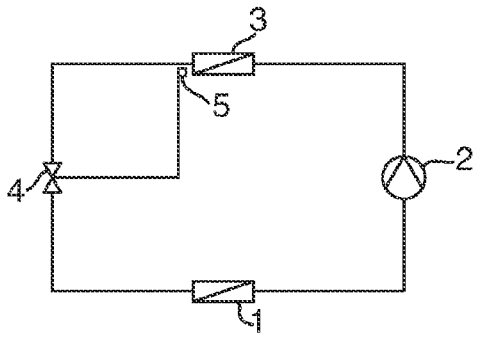
FIG. 1 is a schematic drawing of a refrigeration system comprising a valve according to the present invention.

FIG. 1 is a schematic view of a refrigeration system comprising an evaporator 1, a compressor 2, a heat emitter 3 and an expansion valve 4. The valve 4 is controlled by means of a sensor 5 which senses the temperature at the outlet side of the heat emitter 3. The inlet of the valve 4 is connected to the outlet of the heat emitter 3. Thereby the pressure in the valve chamber of the valve 4 is the same as the pressure in the heat emitter 3. This pressure acts on the first side of the first diaphragm of the valve 4 (see further below). The sensor 5 is connected to a capillary tube containing a filling fluid and being in contact with the first side of the second diaphragm of the valve 4 (see further below). Thus, a change in the temperature at the outlet side of the heat emitter 3 will cause a change in the pressure of the filling fluid, thereby causing a movement of the second diaphragm.

The refrigeration system shown in FIG. 1 is preferably operated at optimal COP or as close to optimal COP as described above. Even though, in principle, a certain pressure of the heat emitter 3 corresponds to each combination of evaporator temperature in the evaporator 1 and temperature at the outlet of the heat emitter 3 when optimal COP is desired, it turns out that the dependence on the evaporations temperature is almost negligible. Thus, the optimal COP pressure of the heat emitter 3 is almost the same at evaporation temperatures from e.g. −10° C. to 10° C., and therefore the evaporation temperature plays only a minor role in obtaining optimal COP, and it can consequently be ignored.

Figure 2:
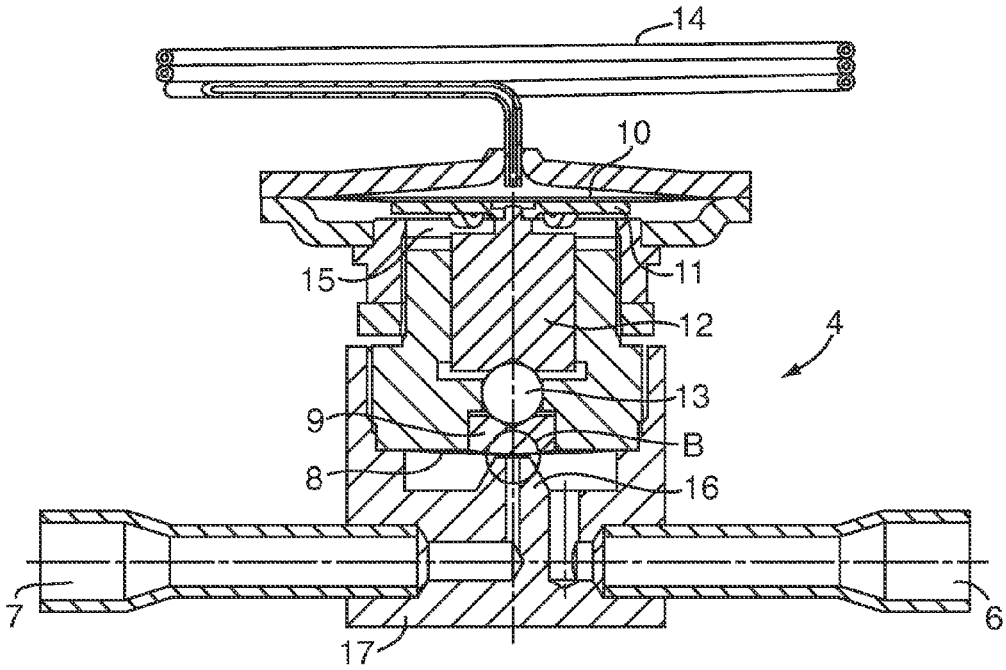
FIG. 2 is a cross sectional view of a valve according to the present invention.

FIG. 2 is a cross sectional view of a valve 4 according to the invention. The figure shows an inlet part 6 and an outlet part 7 for leading a refrigerant towards and away from the valve 4, respectively. The valve 4 comprises a first diaphragm 8 having an active area defined by a first thrust pad 9. It further comprises a second diaphragm 10 having an active area, and a second thrust pad 11. The active area of the second diaphragm 10 is larger than the active area of the first diaphragm 8.

The first diaphragm 8 and the second diaphragm 10 are connected via the first thrust pad 9, the second thrust pad 11, a valve rod 12 and a sphere 13. The sphere 13 ensures that forces transferred between the valve rod 12 and the first thrust pad 9 are transferred in an appropriate manner, i.e. without causing stress in any of the diaphragms.

The valve 4 further comprises a capillary tube 14 containing a filling fluid. The capillary tube 14 is fluidly connected to a bulb serving as a sensor (not shown) for sensing the temperature at the outlet side of a heat emitter of a refrigeration system in which the valve 4 is inserted. This sensing is used for controlling the valve 4. The capillary tube 14 is in fluid connection with a first side of the second diaphragm 10. Thus, the pressure of the filling fluid acts on the active area of the second diaphragm 10. Furthermore, this pressure acts on the active area of the first diaphragm 8 via the second diaphragm 10, the thrust pads 9, 11, the valve rod 12 and the sphere 13. Thereby a kind of 'pressure gearing' between the diaphragms 8, 10 is provided, and it is consequently not necessary to maintain a pressure of the filling fluid in the capillary tube 14 which is as high as the pressure of the refrigerant in the refrigerant system 6, 7. Therefore, in case the valve 4 is to be used in a high pressure refrigeration system, it is not necessary to manufacture special parts for, e.g. the capillary tube 14 or the second diaphragm 10, which are capable of withstanding the forces involved with a high pressure. Thereby it is possible to use standard parts for the valve 4 which were originally intended for use in low pressure refrigeration systems. The standard parts could include the part of the valve 4 comprising the capillary tube 14 and the second diaphragm 10. This is very advantageous and lowers the productions costs of the valve 4 considerably.

Between the diaphragms 8, 10 a chamber 15 is defined. This chamber 15 will typically contain atmospheric air or another suitable gas at atmospheric pressure. Thereby the active areas of first diaphragm 8 as well as the second diaphragm 10 are subject to the pressure from this gas. However, the pressure in the chamber 15 is typically much smaller than the pressure in the refrigerant system 6, 7 and the pressure in the capillary tube 14. Thus, the forces acting on the diaphragms 8, 10 and arising from the pressure in the chamber 15 will typically be negligible compared to forces acting on the active areas of the diaphragms 8, 10 and arising from the pressure of the refrigerant or the filling fluid, respectively, and the other diaphragm 8, 10 via the connecting arrangement 9, 11, 12, 13. Thus, when looking at the resulting force acting on the active area of a diaphragm 8, 10, it is sufficient to take the latter forces into consideration.

The valve 4 is further provided with a nozzle 16 for leading the refrigerant between the inlet part 6 and the outlet part 7 when the valve 4 is in an open state. The nozzle 16 is formed as an integrated part of a lower part 17 of the valve 4. This is advantageous from a productional point of view, since it is much easier and cost effective to manufacture the valve 4 in as few parts as possible. This is due to the fact that the various parts constituting the valve 4 need to be fitted very accurately together, and therefore the more parts, the more accurately each part needs to be manufactured. However, alternatively the nozzle 16 may be formed as a separate part being fitted into the lower part 17 of the valve 4.

Figure 3:
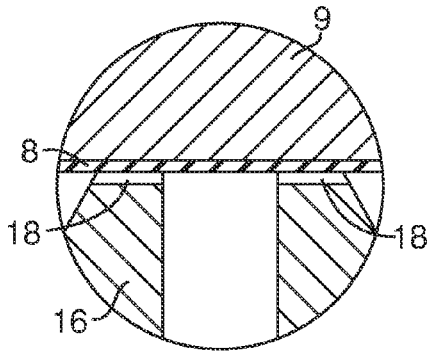
FIG. 3 is an enlarged view of the part designated B in FIG. 2.

FIG. 3 is an enlargement of the part of the valve 4 which in FIG. 2 is designated B. Thus, FIG. 3 shows part of the first diaphragm 8, part of the first thrust pad 9 and part of the nozzle 16. The nozzle 16 has a pair of grooves 18 formed in an upper part thereof. When the valve 4 is in a closed state refrigerant should ideally be prevented from moving from the inlet part 6 to the outlet part 7. However, as explained above, this causes some disadvantages since a pressure difference will be maintained between the inlet part 6 and the outlet part 7 when the valve is in a closed state. The compressor of the refrigeration system will have difficulty starting up against this pressure difference when the valve is in the closed state. The grooves 18 allow a small amount of refrigerant to pass the valve 4 when it is in a closed state, thereby providing an equalization of the pressure at the inlet part 6 and the outlet part 7. The grooves 18 are dimensioned in such a way that an equalization of the pressures is provided on a time scale which is typical for the minimal time the compressor is switched off. This time scale will typically be of the order of 5-10 minutes. In a typical valve the size of each groove 18 will in this case be approximately 0.1 $mm^2$.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A valve, the valve being adapted to be in an open state or in a closed state, refrigerant being allowed to move from an inlet towards an outlet when the valve is in the open state, said movement being substantially prevented when the valve is in the closed state, the valve comprising: a first diaphragm having a first active area and a first side being in fluid contact with a refrigerant having a first pressure, said first diaphragm defining the open and closed states of the valve and a second diaphragm having a second active area and a first side being in fluid contact with a filling fluid having a second pressure, wherein the first and the second diaphragms are operatively connected in such a way that movement of the first/second diaphragm causes a corresponding movement of the second/first diaphragm and wherein the first and second active areas and the first and second pressures are selected in such a way that forces acting on the first active area from the refrigerant are of substantially the same order of magnitude as and oppositely directed to forces acting on the first active area from pressure of the filing fluid acting on the second diaphragm, further comprising means for allowing a bleed of refrigerant from the inlet towards the outlet when the valve is in the closed state.

2. A valve, the valve being adapted to be in an open state or in a closed state, refrigerant being allowed to move from an inlet towards an outlet when the valve is in the open state, said movement being substantially prevented when the valve is in the closed state, the valve comprising:

a first diaphragm having a first active area and a first side being in fluid contact with a refrigerant having a first pressure, said first diaphragm defining the open and closed states of the valve; and a second diaphragm having a second active area and a first side being in fluid contact with a filling fluid having a second pressure, wherein the first and the second diaphragms are operatively connected in such a way that movement of the first/second diaphragm causes a corresponding movement of the second/first diaphragm, wherein the first and second active areas and the first and second pressures are selected in such a way that forces acting on the first active area from the refrigerant are of substantially the same order of magnitude as and oppositely directed to forces acting on the first active area from the second diaphragm, wherein the first and the second diaphragms each comprises a second side, and wherein the second side of the first diaphragm and the second side of the second diaphragm are subject to substantially the same pressure.

* * * * *